US009957977B1

(12) United States Patent
Benford

(10) Patent No.: US 9,957,977 B1
(45) Date of Patent: May 1, 2018

(54) IMPELLER INSTALLATION TOOL

(71) Applicant: Global Marine, Inc., Newport, NC (US)

(72) Inventor: Scott Alan Benford, Newport, NC (US)

(73) Assignee: Global Marine, Inc., Newport, NC (US)

( * ) Notice: Subject to any disclaimer, the term of this patent is extended or adjusted under 35 U.S.C. 154(b) by 372 days.

(21) Appl. No.: 14/930,121

(22) Filed: Nov. 2, 2015

(51) Int. Cl.
*B25B 27/00* (2006.01)
*F04D 29/60* (2006.01)
*F04D 29/18* (2006.01)

(52) U.S. Cl.
CPC ..... *F04D 29/607* (2013.01); *F04D 29/18* (2013.01)

(58) Field of Classification Search
CPC ..... F04D 29/607; F04D 29/18; B25B 27/02; B25B 27/00; C04B 38/0615; C04B 35/00; B22D 43/004; Y10T 29/53883
See application file for complete search history.

(56) References Cited

U.S. PATENT DOCUMENTS 6,394,753 B1 * 5/2002 Maki ..... F04C 2/44 29/267
2011/0146044 A1 * 6/2011 Pecherzewski ..... B25B 27/00 29/278

OTHER PUBLICATIONS

Impeller Tool, found at http://www.impellertool.com/, last accessed Dec. 15, 2017, believed published before filing date of patent application.

* cited by examiner

*Primary Examiner* — David Bryant
*Assistant Examiner* — Lee A Holly
(74) *Attorney, Agent, or Firm* — NK Patent Law, PLLC

(57) ABSTRACT

A tool for installing a flexible impeller within a water pump includes a sleeve having a diameter smaller than an initial diameter of an impeller in a relaxed state, a support extending about an end of the sleeve, and a translation assembly engaged with the support and configured for translating a pushing surface of the translation assembly. In operation, an impeller is contracted into a constrained state and placed in the sleeve, the sleeve is then positioned proximal or in engagement with an opening of the water pump, and the translation assembly is translated such that the pushing surface pushes the impeller into the engine assembly as the translation assembly is translated.

8 Claims, 6 Drawing Sheets

IMPELLER INSTALLATION TOOL

TECHNICAL FIELD

The presently disclosed subject matter is directed towards a tool for use in installing flexible impellers on a drive shaft or other engine component.

BACKGROUND

This disclosure relates to a tool for installing flexible impellers in water pumps, such as for marine use. These impellers are traditionally installed by hand by pressing the impeller against a cam surface formed on an upper side of an impeller cavity wall in the water pump while rotating the impeller into alignment with the water pump drive shaft until keying or other engagement mechanisms are aligned and engaged. The impeller is then urged downwardly onto the shaft while being rotated to uniformly deform and align the impeller blades within the impeller cavity. The impeller is then pressed to the bottom of the cavity for rotation therein with the impeller blades uniformly pressing against the impeller cavity wall. This task can be somewhat difficult when conducted on a bench or other horizontal surface and is very difficult when the pump is engine mounted where visibility is limited. In larger pump applications, the impeller blades are less flexible and overly rigid and more difficult to bend in place.

Some methods may employ a screw driver or blade to help with bending the impeller into place, however, these methods are undesirable due to possible damage caused to the impeller. Accordingly, there remains a need for a device that addresses the various disadvantages associated with previous devices.

SUMMARY

According to one or more embodiments, a tool for installing a flexible impeller within a water pump is provided. The tool includes a sleeve having a diameter smaller than an initial diameter of an impeller in a relaxed state, a support extending about an end of the sleeve, and a translation assembly engaged with the support and configured for translating a pushing surface of the translation assembly. In operation, an impeller is contracted into a constrained state and placed in the sleeve, the sleeve is then positioned proximal or in engagement with an opening of the water pump, and the translation assembly is translated such that the pushing surface pushes the impeller into the engine assembly as the translation assembly is translated.

According to one or more embodiments, the sleeve has a flanged portion about an end thereof for guiding the impeller into the sleeve.

According to one or more embodiments, the flanged portion defines opposing apertures for receiving the translation assembly.

According to one or more embodiments, the translation assembly includes a post extending into the apertures.

According to one or more embodiments, the post defines recessed chamfers for resting against the apertures and constraining side-to-side movement of the translation assembly when engaged with the apertures.

According to one or more embodiments, the translation assembly is selectively engageable.

According to one or more embodiments, the translation assembly includes a threaded recess and the pushing surface is engaged with a threaded rod that engages with the threaded recess.

According to one or more embodiments, the tool further includes a fastener head on the threaded rod for imparting movement to the threaded rod.

According to one or more embodiments, a method includes using a tool having a sleeve having a diameter smaller than an initial diameter of an impeller in a relaxed state, a support extending about an end of the sleeve, and a translation assembly engaged with the support and configured for translating a pushing surface of the translation assembly, compressing the impeller and positioning within the sleeve, engaging the translation assembly with the compressed impeller, positioning the sleeve proximal or into engagement with a water pump cavity, and actuating the translation assembly to impart movement to the impeller until the impeller is received within the water pump cavity.

According to one or more embodiments, the translation assembly is selectively engaged with the sleeve after the impeller is positioned within the sleeve.

According to one or more embodiments, the sleeve has a flanged portion about an end thereof and the impeller is positioned within the sleeve by guiding the impeller within the flanged portion.

According to one or more embodiments, the translation assembly includes a threaded rod received within a threaded recess, and actuating the translation assembly includes rotation of the threaded rod.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Further, the claimed subject matter is not limited to implementations that solve any or all disadvantages noted in any part of this disclosure.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed. In the drawings.

DETAILED DESCRIPTION

Figure 1:
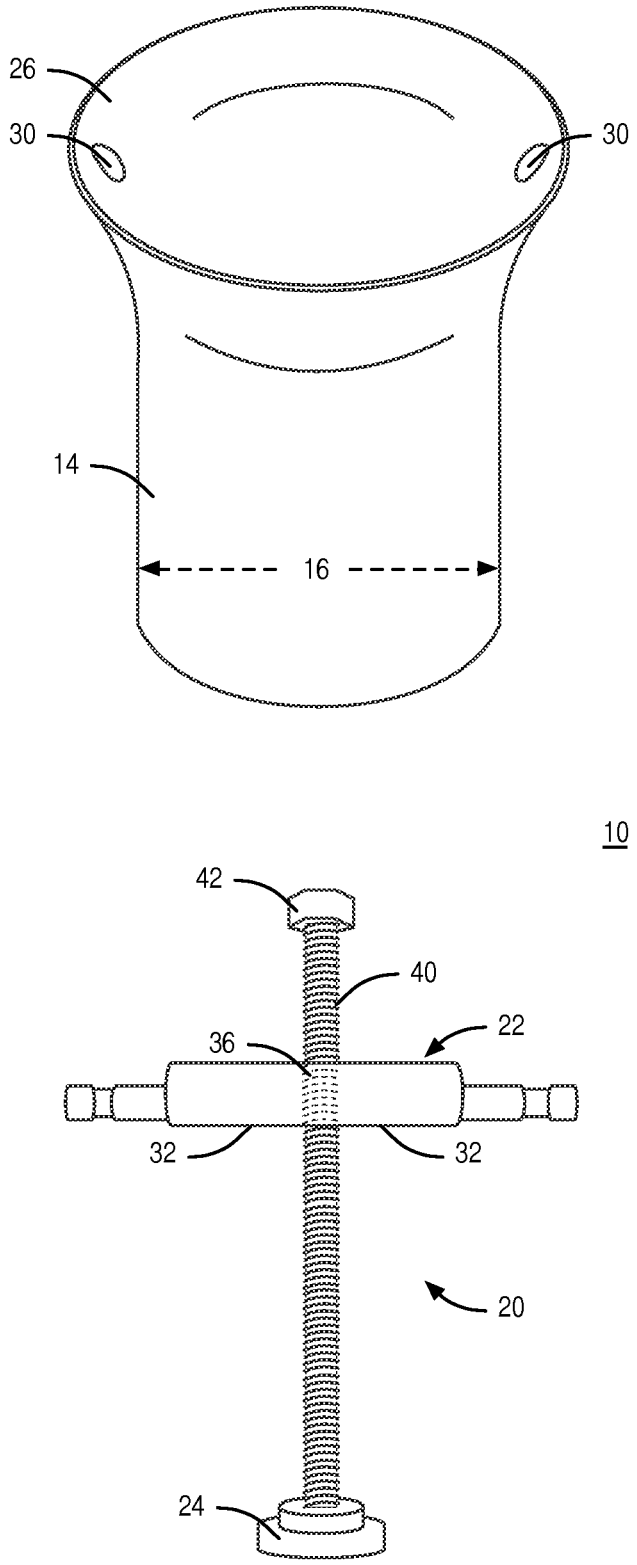
FIG. 1 is a front view of a impeller tool according to one or more embodiments.
Figure 2:
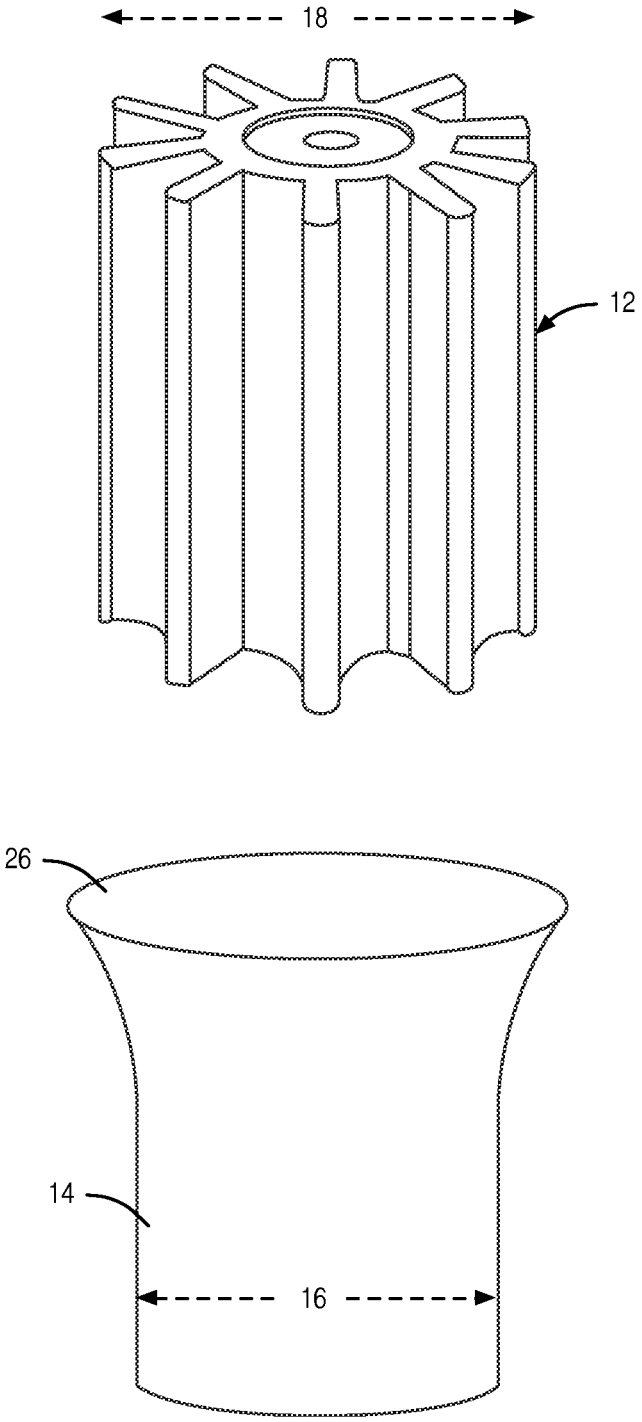
FIG. 2 is a front view of the impeller tool where an impeller is positioned proximal a sleeve of the impeller tool according to one or more embodiments.

The presently disclosed subject matter now will be described more fully hereinafter with reference to the accompanying drawings, in which some, but not all embodiments are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

A tool for installing a flexible impeller within a water pump is disclosed herein, where the tool is indicated as 10. The impeller is indicated as 12 and may be installed on a splined water pump shaft as is conventional. The water pump is indicated as 1. The tool may be used for installing any flexible impeller device within any appropriately configured equipment. The tool 10 includes a sleeve 14 having a diameter 16 smaller than an initial diameter 18 of the impeller 12 in a relaxed state. The impeller 12 is flexible in nature and includes a plurality of radially extending ribs that form a fan or similar surface for moving water in a water pump. The impeller 12 can thus be constricted by pressing the radially extending ribs to constrain or otherwise compress the ribs to reduce the diameter of the impeller 12.

A support 20 extends about an end of the sleeve. A translation assembly 22 is engaged with the support 20 and is configured for translating a pushing surface 24 of the translation assembly 22. The pushing surface 24 is shown as a swivel plate on an end of the translation assembly 22 but may be any appropriately configured surface or mechanism.

Figure 3:
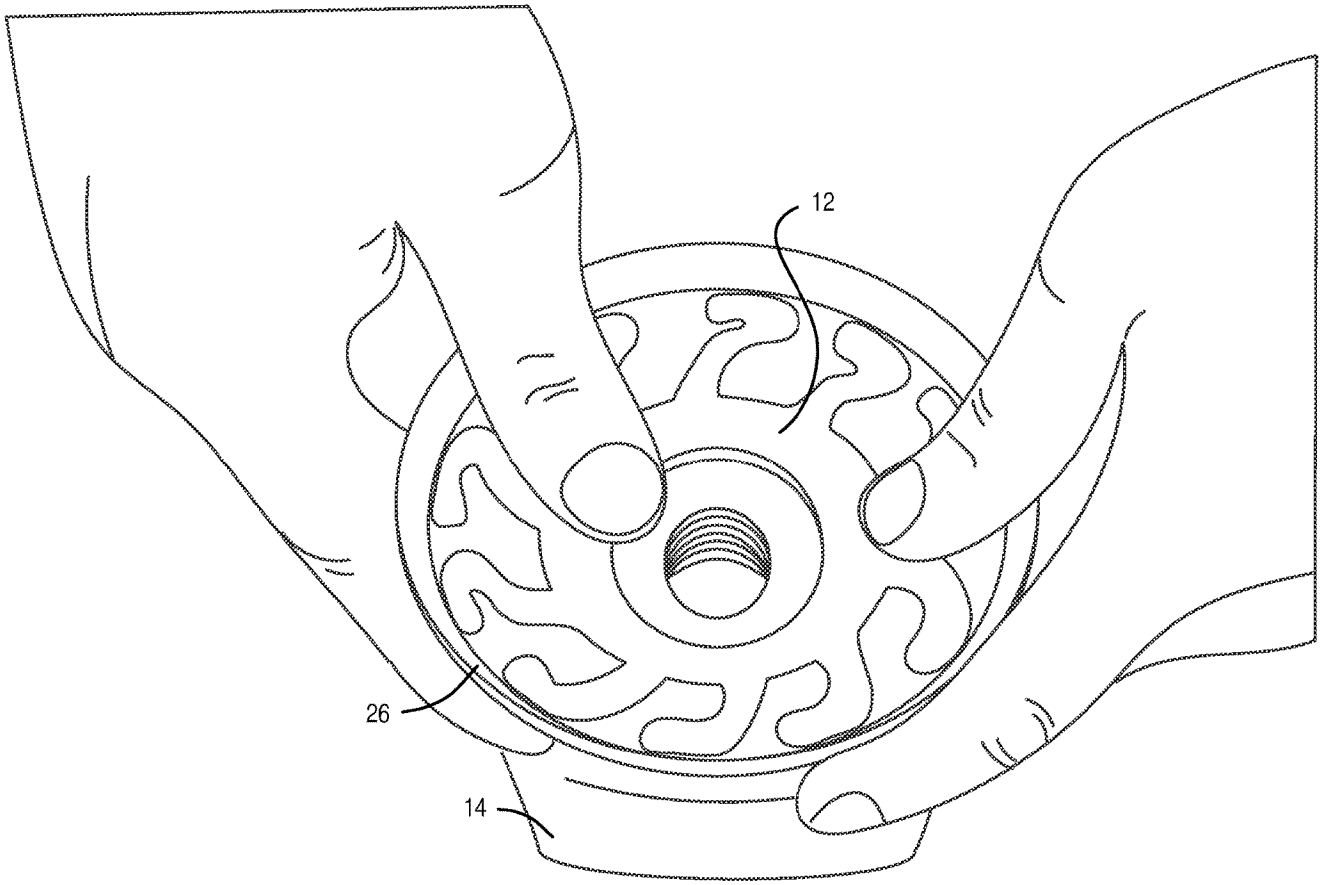
FIG. 3 is a perspective view of the impeller being positioned within the sleeve of the impeller tool according to one or more embodiments.
Figure 4:
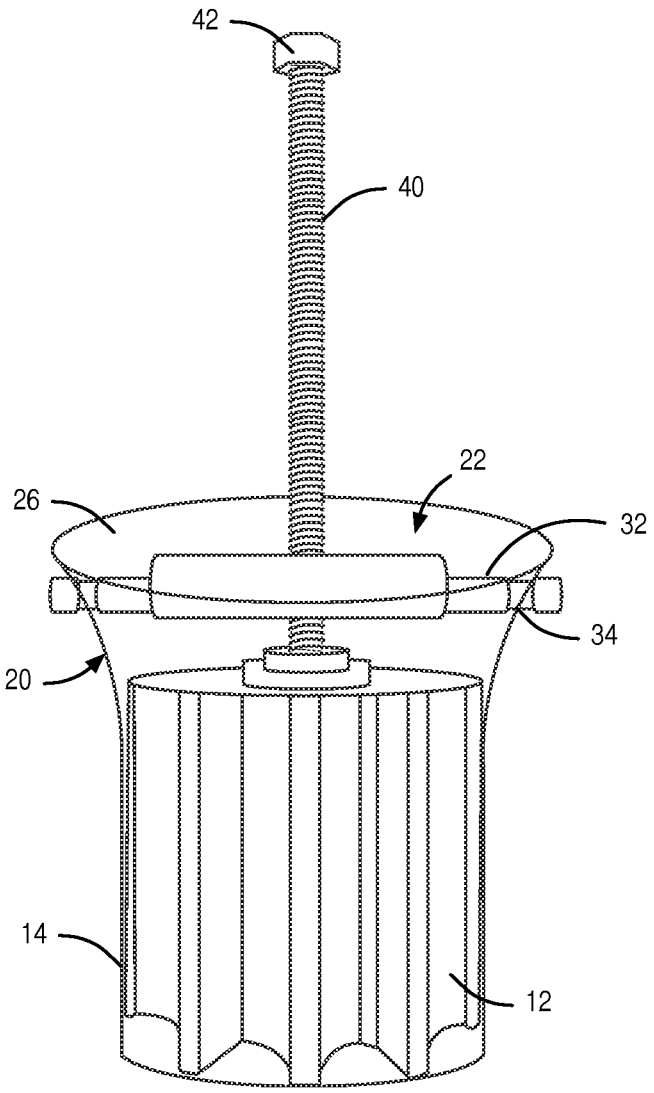
FIG. 4 is a front view of the impeller tool where a translation assembly is engaged with the sleeve according to one or more embodiments.
Figure 5:
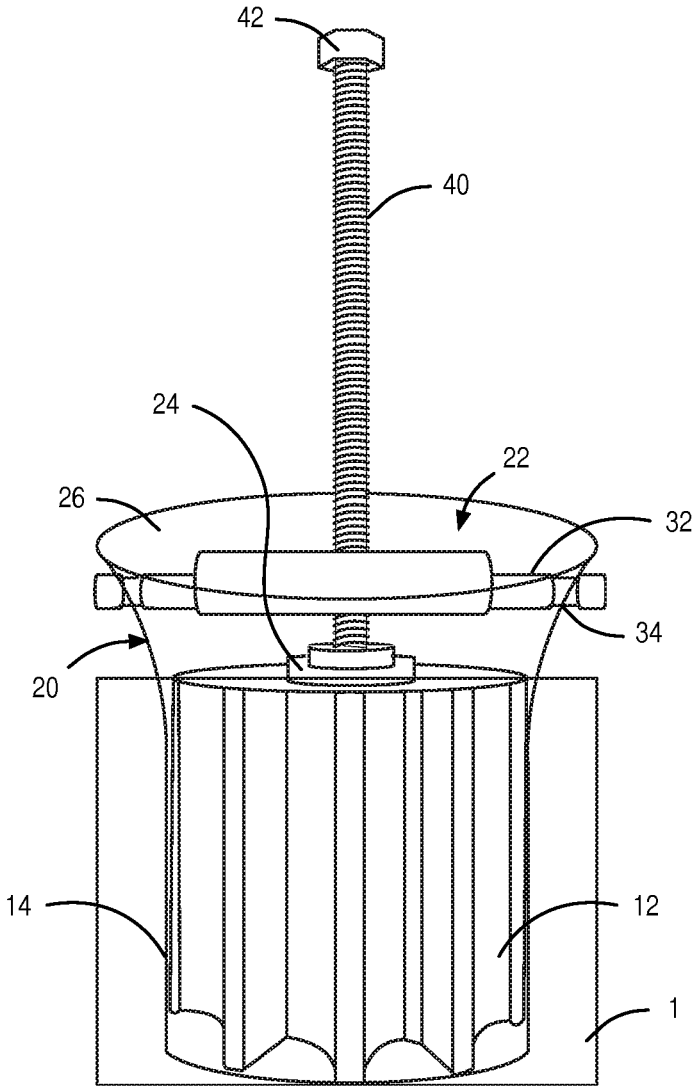
FIG. 5 is a front view of the impeller tool positioned proximal a water pump according to one or more embodiments.
Figure 6:
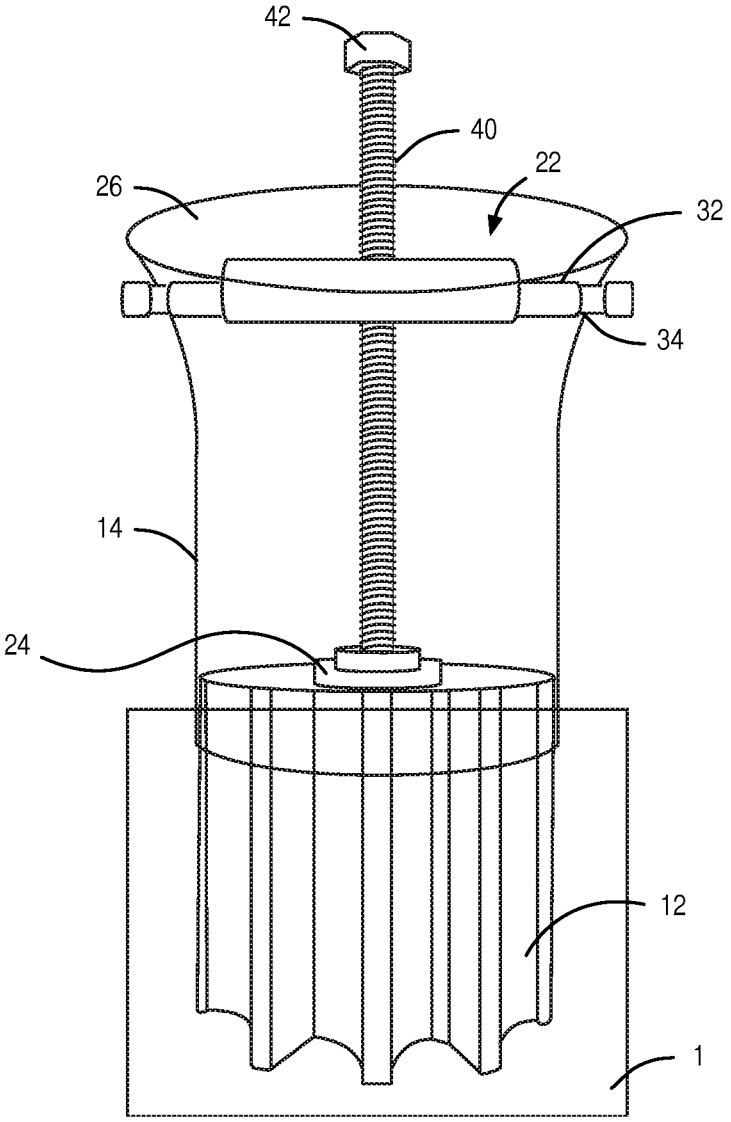
FIG. 6 is a front view of the impeller tool where the impeller has been translated into the water pump according to one or more embodiments.

In operation, the impeller 12 is contracted into a constrained state by bending or otherwise contorting the ribs to reduce the diameter of the impeller. The reduced diameter impeller 12 is then placed in the sleeve 14. This may be done by pushing with an operator's hands onto the impeller 12 and forcing the impeller 12 into the sleeve 14, or a tool such as a blade, press, or the like may also be employed. This is illustrated with reference to FIG. 3. The translation assembly 22 is then installed about the sleeve 14 as illustrated in FIG. 4. The sleeve 14 is then positioned proximal or in engagement with an opening of the water pump 1. The sleeve 14 should be positioned such that, upon egress of the impeller 12, the impeller 12 is positioned at or proximal to a desired installation location. The translation assembly 22 is then translated such that the pushing surface 24 pushes the impeller 12 into the water pump 1 as the translation assembly 22 is translated as illustrated in FIG. 6.

The sleeve 14 has a flanged portion 26 about an end thereof for guiding the impeller 12 into the sleeve 14. In one or more embodiments, the flanged portion 26 defines opposing apertures 30 for receiving the translation assembly 22 or the support 20. This advantageously allows for selective engagement of the translation assembly 22 with the sleeve, such that the impeller 12 can be first installed within the sleeve 14 and then the translation assembly 22 can be installed and the translation assembly 22 does not impede installation or insertion of the impeller 12 within sleeve 14.

This is effectuated because the translation assembly 22 includes posts 32 that extend into apertures 30. The posts 32 may further define recessed chamfers or cutouts 34 for resting against a surface of the sleeve 14 defined by the apertures 30 and constraining side-to-side movement of the translation assembly 22 when engaged with the apertures 30.

In one or more embodiments, the translation assembly 22 includes a threaded recess 36 and the pushing surface 24 is engaged with a threaded rod 40 that engages with the threaded recess 36. In this manner, rotation of the threaded rod 40 within threaded recess 36 causes translation of the pushing surface 24 in order to cause translation thereof, and thus impart translation to the impeller 12. There may be provided a fastener head 42 on the threaded rod 40 for imparting movement thereto.

In this manner, one or more methods of using the device 10 are provided. The method includes compressing the impeller 12 and positioning within the sleeve 14. The method includes engaging the translation assembly 22 with the compressed impeller 12. In one or more embodiments, if the impeller 12 is positioned within sleeve 14 while the translation assembly 22 is not engaged therewith, the translation assembly 22 is then engaged with the sleeve 14. The method may include positioning the sleeve 14 proximal or into engagement with a water pump cavity. The method may then include actuating the translation assembly 22 to impart movement to the impeller 12 until the impeller 12 is received within the water pump cavity 1. The flanged portion 26 of the sleeve 14 provides guiding characteristics for the impeller 12 being positioned within sleeve 14. The actuation assembly 22 may be actuated with a power tool engaged with the fastener head 42.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A tool for installing a flexible impeller within a water pump of an engine assembly, the tool comprising:

a sleeve having a diameter smaller than an initial diameter of an impeller in a relaxed state;

a support extending about an end of the sleeve; and a translation assembly engaged with the support and configured for translating a pushing surface of the translation assembly, wherein, in operation, an impeller is contracted into a constrained state and placed in the sleeve, the sleeve is then positioned proximal or in engagement with an opening of the water pump, and the translation assembly is translated such that the pushing surface pushes the impeller into the engine assembly as the translation assembly is translated, wherein the sleeve has a flanged portion about an end thereof for guiding the impeller into the sleeve, wherein the flanged portion defines opposing apertures for receiving the translation assembly, wherein the translation assembly includes a post extending into the apertures.

2. The tool according to claim 1, wherein the post defines recessed chamfers for resting against the apertures and constraining side-to-side movement of the translation assembly when engaged with the apertures.

3. The tool according to claim 1, wherein the translation assembly is selectively engageable.

4. The tool according to claim 1, wherein the translation assembly includes a threaded recess and the pushing surface is engaged with a threaded rod that engages with the threaded recess.

5. The tool according to claim 4, further including a fastener head on the threaded rod for imparting movement to the threaded rod.

6. A method comprising:

using a tool having a sleeve having a diameter smaller than an initial diameter of an impeller in a relaxed state, a support extending about an end of the sleeve, and a translation assembly engaged with the support and configured for translating a pushing surface of the translation assembly, compressing the impeller and positioning within the sleeve, wherein the sleeve has a flanged portion about an end thereof for guiding the impeller into the sleeve, wherein the flanged portion defines opposing apertures for receiving the translation assembly, wherein the translation assembly includes a post extending into the apertures;

engaging the translation assembly with the compressed impeller by inserting the post into the apertures;

positioning the sleeve proximal or into engagement with a water pump cavity; and actuating the translation assembly to impart movement to the impeller until the impeller is received within the water pump cavity.

7. The method of claim 6, wherein the translation assembly is selectively engaged with the sleeve after the impeller is positioned within the sleeve.

8. The method of claim 6, wherein the translation assembly includes a threaded rod received within a threaded recess, and actuating the translation assembly includes rotation of the threaded rod.

* * * * *